US008479506B2

(12) United States Patent
Yaguchi et al.

(10) Patent No.: US 8,479,506 B2
(45) Date of Patent: Jul. 9, 2013

(54) PISTON ENGINE

(75) Inventors: Hiroshi Yaguchi, Susono (JP); Daisaku Sawada, Gotemba (JP); Masaaki Katayama, Susono (JP)

(73) Assignee: Toyota Jidosha Kabushiki Kasiha, Toyota-shi (JP)

( * ) Notice: Subject to any disclaimer, the term of this patent is extended or adjusted under 35 U.S.C. 154(b) by 873 days.

(21) Appl. No.: 12/640,455

(22) Filed: Dec. 17, 2009

(65) Prior Publication Data

US 2010/0146962 A1 Jun. 17, 2010

(30) Foreign Application Priority Data

Dec. 17, 2008 (JP) ..... 2008-321553

(51) Int. Cl.
*F01B 29/08* (2006.01)
*F01B 29/10* (2006.01)

(52) U.S. Cl.
USPC ..... 60/521; 60/517; 60/522

(58) Field of Classification Search
USPC ..... 60/517–526
See application file for complete search history.

(56) References Cited

U.S. PATENT DOCUMENTS

| | | | | |
|---|---|---|---|---|
| 3,782,859 | A * | 1/1974 | Schuman | 417/207 |
| 3,889,465 | A * | 6/1975 | Gartner | 60/521 |
| 3,991,574 | A * | 11/1976 | Frazier | 60/645 |
| 4,856,280 | A * | 8/1989 | Chagnot | 60/522 |
| 7,581,393 | B2 * | 9/2009 | Yaguchi et al. | 60/521 |
| 7,908,855 | B2 * | 3/2011 | Smith | 60/516 |
| 2010/0139263 | A1 | 6/2010 | Katayama et al. | |

FOREIGN PATENT DOCUMENTS

| | | |
|---|---|---|
| JP | 2005106009 A | 4/2005 |
| JP | 2006348893 | 12/2006 |
| JP | 2008267258 A | 11/2008 |

OTHER PUBLICATIONS

Japanese Patent Application No. 2008-314599.

* cited by examiner

*Primary Examiner* — Hoang Nguyen
(74) *Attorney, Agent, or Firm* — Gifford, Krass, Sprinkle, Anderson & Citkowski, P.C.

(57) ABSTRACT

A Stirling engine is provided with a fluid passage that connects a low temperature-side actuating fluid space and a crankcase inner space, and a passage opening/closing valve that is provided in the fluid passage and that opens and closes the fluid passage. Upon stopping of the Stirling engine, the passage opening/closing valve enables communication through the fluid passage, at a region at which the piston floats in the cylinder. This region is determined based on the pressure of an actuating fluid in the actuating fluid space and the rotational speed of a crankshaft of the Stirling engine.

8 Claims, 7 Drawing Sheets

PISTON ENGINE

INCORPORATION BY REFERENCE

The disclosure of Japanese Patent Application No. 2008-321553 filed on Dec. 17, 2008 including the specification, drawings and abstract is incorporated herein by reference in its entirety.

BACKGROUND OF THE INVENTION

1. Field of the Invention

The invention relates to a piston engine that uses a gas bearing interposed between a piston and a cylinder.

2. Description of the Related Art

Recent years have witnessed growing interest in Stirling engines, which have excellent theoretical thermal efficiency, for recovering waste heat from internal combustion engines installed in cars, buses, trucks and the like, and for recovering waste heat in factories. Japanese Patent Application Publication No. 2005-106009 (JP-A-2005-106009) discloses a Stirling engine in which a gas bearing is interposed between a piston and a cylinder, and in which a piston is supported by an approximate linear mechanism. The Stirling engine disclosed in JP-A-2005-106009 is a piston engine in which a piston executes a reciprocating motion in a cylinder, with a gas bearing interposed in the small clearance between the piston and the cylinder. As a result, the piston and the cylinder might come into contact with each other during stopping of the Stirling engine.

SUMMARY OF THE INVENTION

The invention provides a piston engine having a structure in which a gas bearing is interposed between a piston and a cylinder, and in which contact between the piston and the cylinder is suppressed during stopping of the piston engine.

In a first aspect of the invention, a piston engine includes a cylinder; a piston that moves reciprocally in the cylinder, wherein the piston engine converts reciprocating motion of the piston into rotational motion and outputs the rotational motion; a gas bearing that is interposed between the cylinder and the piston; a fluid passage that connects a first space formed in the cylinder and filled with an actuating fluid, with a second space on an opposite side of the piston to the first space; and a passage opening/closing portion that is provided in the fluid passage and opens and closes the fluid passage wherein, upon stopping of the piston engine, the passage opening/closing portion enables communication through the fluid passage when the piston engine is running at a region at which the piston floats in the cylinder, the region being determined based on the pressure of the actuating fluid in the first space and the engine rotational speed of the piston engine.

In the above piston engine, the first space may be an actuating fluid space filled with the actuating fluid, and the second space may be a space in which a motion conversion member that converts reciprocating motion of the piston into rotational motion is disposed.

In the above piston engine, the piston engine may operate through heating of the actuating fluid by a heater, such that when the piston engine operates on account of residual heat in the heater, the passage opening/closing portion delays the timing for opening the fluid passage up to a boundary between a region at which the piston floats in the cylinder and a region at which the piston does not float in the cylinder.

The above piston engine may be a Stirling engine that includes a first cylinder; a first piston that moves reciprocally in the first cylinder; a second cylinder; and a second piston that moves reciprocally in the second cylinder; such that the heater is disposed between the first cylinder and the second cylinder.

The first aspect of the invention allows suppressing contact between a piston and a cylinder during stopping of a piston engine having a structure in which a gas bearing is interposed between a piston and a cylinder.

In a second aspect of the invention, a piston engine includes a cylinder; a piston that moves reciprocally in the cylinder, wherein the piston engine converts the reciprocating motion of the piston into rotational motion and outputs the rotational motion; a gas bearing interposed between the cylinder and the piston; a fluid passage that connects a first space formed in the cylinder and filled with an actuating fluid, with a second space on an opposite side of the piston to the first space; and a passage opening/closing portion that is provided in the fluid passage and opens and closes the fluid passage wherein, upon stopping of the piston engine, the passage opening/closing portion enables communication through the fluid passage when the piston engine is running at a state in which the cylinder and the piston are not in contact with each other.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Embodiments of the invention are explained next in detail with reference to accompanying drawings. The invention is in no way meant to be limited by the explanation below. The constituent elements in the embodiments below encompass so-called equivalent constituent elements, such as constituent elements easily conceivable by a person skilled in the art, or substantially identical constituent elements. In the explanation below, a Stirling engine is illustrated as an example of a piston engine, but the piston engine is not limited to a Stirling engine. The explanation below relates to an example where the waste heat of an internal combustion engine installed in a vehicle or the like is recovered by way of a Stirling engine, which is a piston engine. However, the object of waste heat recovery is not limited to an internal combustion engine. The invention can be used, for instance, for waste heat recovery in factories, plants and power generation facilities.

EMBODIMENT

The piston engine according to the embodiment has a structure in which a gas bearing is interposed between a piston and a cylinder. Accordingly, an actuating fluid is introduced, for instance, from an actuating fluid space in the cylinder into a pressure-accumulating space that is enclosed by the outer shell of the piston and by a partition member inside the piston. The actuating fluid is caused to flow out of gas supply holes, provided in the lateral portion of the piston, into the gap between the piston and the cylinder. A gas bearing forms as a result between the piston and the cylinder. In the embodiment, such a piston engine is provided with a fluid passage that connects a first space filled with the actuating fluid, with a second space on the side of the piston opposite the first space; and a passage opening/closing means that opens and closes the fluid passage. Upon stopping of the piston engine, the passage opening/closing means enables communication through the fluid passage when the piston engine is running at a region where the piston floats in the cylinder, the region being determined on the basis of the engine rotational speed of the piston engine and the pressure of the actuating fluid in the first space. The gas bearing may be a static-pressure gas bearing or a dynamic-pressure gas bearing. The engine rotational speed of the piston engine refers to the rotational speed of the output shaft of the piston engine. The rotational speed of the crankshaft becomes the engine rotational speed when the reciprocating motion of the piston is converted into rotational motion by the crankshaft and is extracted therefrom.

Figure 1:
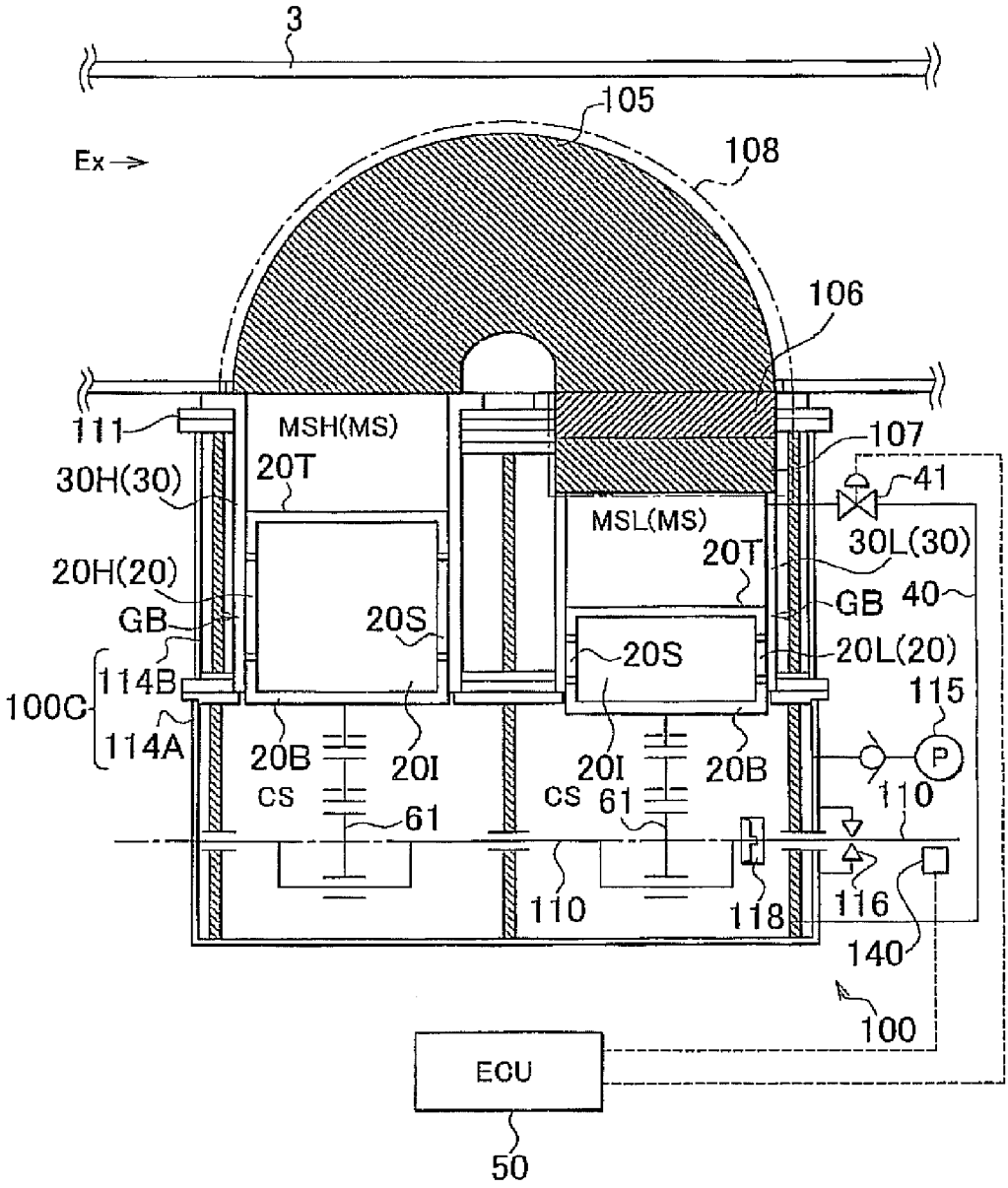
FIG. 1 is a cross-sectional diagram illustrating the configuration of a Stirling engine as a piston engine according to an embodiment.
Figure 2:
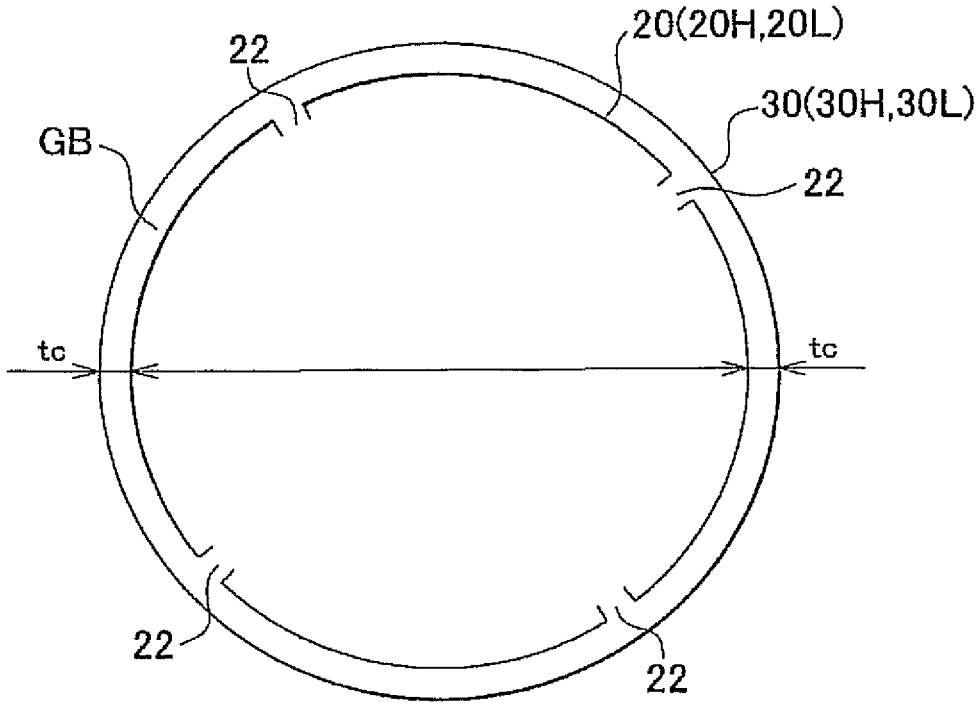
FIG. 2 is a plan-view diagram illustrating a gas bearing in the Stirling engine according to the embodiment.
Figure 3:
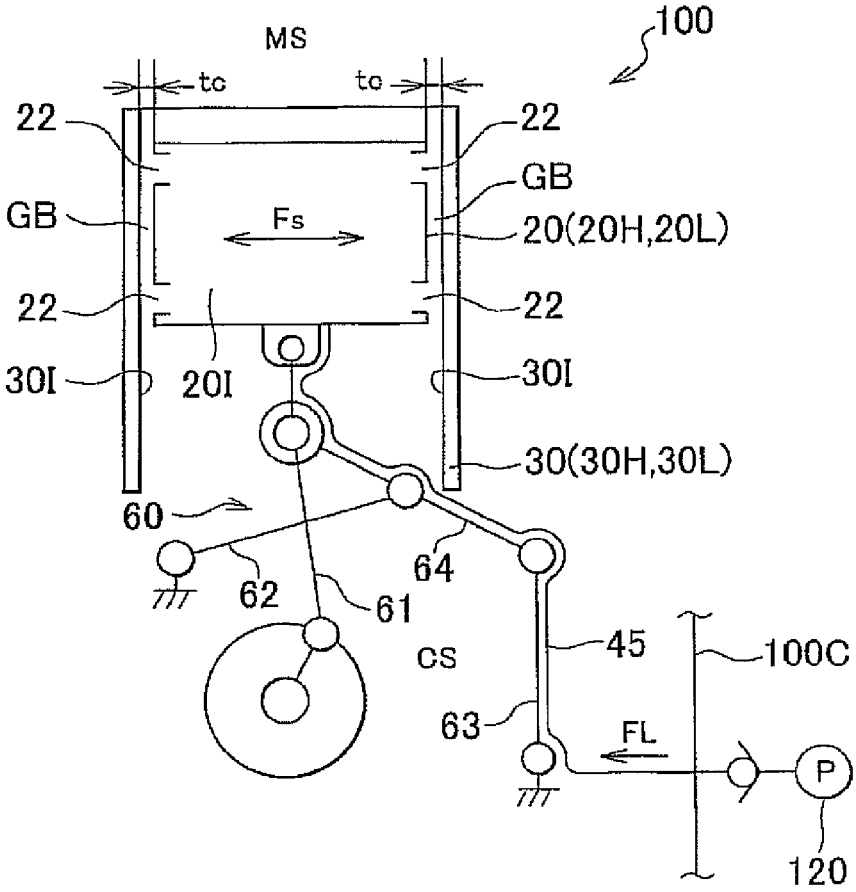
FIG. 3 is an explanatory diagram illustrating an example of the configuration of the gas bearing in the Stirling engine according to the embodiment, and illustrating a support structure of a piston.

FIG. 1 is a cross-sectional diagram illustrating the configuration of a Stirling engine as a piston engine according to the embodiment. FIG. 2 is a plan view diagram illustrating a gas bearing in the Stirling engine according to the embodiment. FIG. 3 is an explanatory diagram illustrating an example of the configuration of the gas bearing in the Stirling engine according to Embodiment, mid illustrating a support structure of a piston. A Stirling engine 100 as the piston engine according to Embodiment is a so-called alpha-type inline dual-cylinder Stirling engine. In the embodiment, the Stirling engine 100 has a heat exchanger 108 disposed in a heater case 3 that functions as a passage through which there flows exhaust gas Ex from an internal combustion engine. The Stirling engine 100 is used thus as a waste heat recovery device that recovers thermal energy from the exhaust gas Ex of a thermal engine (for instance, an internal combustion engine).

In the Stirling engine 100 there are serially arranged a high temperature-side piston 20H, as a first piston, housed in a high temperature-side cylinder 30H, as a first cylinder; and a low temperature-side piston 20L, as a second piston, housed in a low temperature-side cylinder 30L, as a second cylinder. Hereafter, the high temperature-side cylinder 30H and the low temperature-side cylinder 30L will be referred to as cylinder 30 when no distinction is made between the two cylinders. Likewise, the high temperature-side piston 20H and the low temperature-side piston 20L will be referred to as piston 20 when no distinction is made between the two pistons. In the Stirling engine 100 according to Embodiment, as described below, gas bearings GB are interposed between the high temperature-side cylinder 30H and the high temperature-side piston 20H, and between the low temperature-side cylinder 30L and the low temperature-side piston 20L.

The high temperature-side cylinder 30H and the low temperature-side cylinder 30L are supported on, and fixed to, directly or indirectly, a base 111, as a reference body. In the embodiment, the base 111 provided in the Stirling engine 100 is a positional reference of the various constituent elements of the Stirling engine 100. Such a configuration allows securing the relative positional precision among the various constituent elements, and allows therefore maintaining the clearance between pistons and cylinders with good precision. The function of the gas bearings GB can be fully brought out as a result.

The heat exchanger 108, which has a heater 105, a regenerator 106 and a cooler 107, is provided between the high temperature-side cylinder 30H and the low temperature-side cylinder 30L. One end of the heater 105 is connected to the high temperature-side cylinder 30H, so that an actuating fluid flows in and out between the heater 105 and the high temperature-side cylinder 30H. In the heater 105, the actuating fluid is heated by heat from the exhaust gas Ex that comes from the internal combustion engine and that flows through a heater case 3. The heated actuating fluid flows into the high temperature-side cylinder 30H. The heater 105 can have a plurality of tubes of a material having high thermal conductivity and excellent thermal resistance. In the embodiment, the heater 105 is substantially U-shaped. As a result, the heater 105 can be disposed easily in comparatively narrow spaces, for instance in the exhaust gas passages of an internal combustion engine. The other end of the heater 105, i.e. the end on the opposing side to the high temperature-side cylinder 30H, is connected to the regenerator 106. Actuating fluid flows in and out between the heater 105 and the regenerator 106.

The end of the regenerator 106 on the opposite side to the end connected to the heater 105 is connected to the cooler 107, to enable inflow of actuating fluid from the heater 105 or the cooler 107. The regenerator 106 may have, for instance, a porous heat-storage material. The end of the cooler 107 on the opposite side to the end connected to the regenerator 106 is connected to the low temperature-side cylinder 30L. The actuating fluid flows in and out between the cooler 107 and the low temperature side cylinder 30L. The cooler 107 cools the actuating fluid that flows through the regenerator 106. The cooler 107 can have a plurality of tubes of a material having high thermal conductivity and excellent thermal resistance. The cooler 107 may rely on air cooling or water cooling. In the embodiment, the heat exchanger 108 is configured as described above in such a manner that actuating fluid passing through the heat exchanger 108 flows in and out of the high temperature-side cylinder 30H and the low temperature side cylinder 30L.

The interior of the high temperature-side cylinder 30H, the low temperature side cylinder 30L and the heat exchanger 108 is filled with an actuating fluid (air, in the embodiment). The Stirling engine 100 is driven on account of the heat supplied by the heater 105. A Stirling cycle is thus established, as described above. The space of the high temperature-side cylinder 30H filled with the actuating fluid is called a high temperature-side actuating fluid space MSH, while the space of the low temperature-side cylinder 30L filled with the actuating fluid is called a low temperature-side actuating fluid space MSL. When no distinction is made between the above two, they will be simply referred to as actuating fluid space MS.

The high temperature-side piston 20H and the low temperature-side piston 20L are supported in the high temperature-side cylinder 30H and the low temperature side cylinder 30L by way of respective gas bearings GB. That is, the pistons are supported in the cylinders by means of a structure having no piston rings and employing no lubricant. Friction between the pistons and the cylinders is reduced as a result, which allows increasing the efficiency of the Stirling engine 100. The reduction in friction between the pistons and the cylinders allows the Stirling engine 100 to recover thermal energy out of waste heat, even when the Stirling engine 100 is used under operation conditions that involve low thermal sources and low temperature differences, for instance in the recovery of waste heat from an internal combustion engine.

To configure the gas bearings GB, a predetermined clearance tc is left between the piston 20 (high temperature-side piston 20H, low temperature-side piston 20L) and the cylinder 30 (high temperature-side cylinder 30H, low temperature side cylinder 30L), as illustrated in FIG. 2. The clearance tc, which ranges from several μm to several tens of μm, runs around the entire periphery of the piston 20. The reciprocating motion of the high temperature-side piston 20H and the low temperature-side piston 20L is transmitted to a crankshaft 110, as an output shaft, by way of a connecting rod 61, to be converted into rotational motion. Thus, the crankshaft 110 is a motion conversion member that converts reciprocating motion of the piston 20 into rotational motion.

The gas bearings GB have low ability (load ability) for resisting a force in the diameter direction (horizontal direction, thrust direction) of the piston 20. Therefore, the side force Fs of the piston 20 is preferably set to substantially 0. It becomes therefore necessary to increase the linear motion precision of the piston 20 in the axis (center axis) of the cylinder 30. To this end, the high temperature-side piston 20H and the low temperature-side piston 20L in the embodiment are supported by an approximate linear mechanism (for instance, a grasshopper mechanism) 60, as illustrated in FIG. 3.

The approximate linear mechanism 60 in the embodiment utilizes a grasshopper mechanism. The approximate linear mechanism 60 has a first arm 62, one end of which is pivotably mounted on a chassis 100C of the Stirling engine 100; a second arm 63 having likewise one end pivotably mounted on the chassis 100C of the Stirling engine 100; and a third arm 64, having one end pivotably coupled to the end of the connecting rod 61 and the other end pivotably coupled to the other end of the second arm 63. An end of the connecting rod 61 other than the end pivotably mounted to the crankshaft 110 is pivotably coupled to the end of the third arm 64. The other end of the first arm 62 is pivotably coupled to halfway between both ends of the third arm 64.

Using an approximate linear mechanism 60 having such a configuration allows the high temperature-side piston 20H and the low temperature-side piston 20L to execute a substantially linear reciprocating motion. As a result, the side force Fs of the high temperature-side piston 20H and the low temperature-side piston 20L becomes virtually 0, so that the pistons 20 can be sufficiently supported by the gas bearings GB that have little load ability. The approximate linear mechanism 60 that supports the piston 20 is not limited to a grasshopper mechanism, and may be a Watt linkage or the like.

The dimensions required for achieving the same linear motion precision can be smaller in the grasshopper mechanism used as the approximate linear mechanism 60 in the embodiment, as compared with other approximate linear mechanisms. This is advantageous in that the Stirling engine 100 as a whole can be made more compact thereby. In particular, a compact Stirling engine 100 as a whole affords a greater degree of freedom as regards the arrangement of the Stirling engine 100 according to the embodiment when the grasshopper mechanism is used for waste heat recovery in an internal combustion engine equipped with the Stirling engine 100, which is disposed to that end inside a limited space, for example, when arranging the heat exchanger 108 in the exhaust gas passage in the internal combustion engine. Moreover, the weight of the mechanism required for achieving the same linear motion precision is smaller in a grasshopper mechanism than in other mechanisms. This is advantageous in terms of enhancing thermal efficiency. Further, the grasshopper mechanism has a comparatively simple construction, and hence is advantageous in that the mechanism can be manufactured and assembled easily, with reduced manufacturing costs.

As illustrated in FIG. 1, the constituent elements of the Stirling engine 100, i.e. the high temperature-side cylinder 30H, the high temperature-side piston 20H, the connecting rod 61, the crankshaft 110 and so forth, are housed in the chassis 100C. The chassis 100C of the Stirling engine 100 includes a crankcase 114A and a cylinder block 114B. The crankshaft 110 is disposed in the space CS within the crankcase 114A (crankcase inner space) configuring the interior of the chassis 100C, with the space CS being filled with a gas. In the embodiment, the gas is the same as the actuating fluid of the Stirling engine 100. The gas that fills the crankcase inner space CS is pressurized by a pump 115 as a pressure adjustment means. The pump 115 may be driven, for instance, by the internal combustion engine whose waste heat is to be recovered by the Stirling engine 100, or may be driven by way of a driving means such as an electric motor. Also, the pump 115 may be omitted, and the gas that fills the crankcase inner space CS may be pressurized beforehand to a predetermined pressure.

In the Stirling engine 100, when the temperature difference between the heater 105 and the cooler 107 is the same, the pressure difference at the high-temperature side and the low-temperature side becomes higher as the average pressure of the actuating fluid increases, so that a higher output is obtained. In the Stirling engine 100 according to the embodiment, the actuating fluid in the actuating fluid space MS is kept at a high pressure through pressurization of the gas that fills the crankcase inner space CS. Greater output can be extracted thereby from the Stirling engine 100. As a result, greater output can be obtained from the Stirling engine 100 even when only a low-quality heat source can be used, as is the case in waste heat recovery. Herein, the output of the Stirling engine 100 increases substantially proportionally to the pressure of the gas that fills the chassis 100C.

A sealed bearing 116 is mounted to the chassis 100C of the Stirling engine 100. The crankshaft 110 is supported by the sealed bearing 116. Although the gas that fills the interior of the chassis 100C in the Stirling engine 100 is pressurized, leakage of gas that fills the interior of chassis 100C can be kept to a minimum by way of the scaled bearing 116. The output of the crankshaft 110 can be extracted out of the chassis 100C by way of for instance, a flexible coupling 118 such as an Oldham coupling.

As illustrated in FIGS. 1 and 3, the piston 20 provided in the Stirling engine 100 has an outer shell having a top pardon 20T, a side portion 20S and a bottom portion 20B, and a pressure-accumulating space 20I as the space enclosed by the top portion 20T, the side portion 20S and the bottom portion 20B. In the Stirling engine 100, actuating fluid FL is supplied into the pressure-accumulating space 20I of the piston 20 via a gas supply passage 45, by a gas bearing pump 120, as a gas bearing pressure generation means, that is disposed outside the chassis 100C. The actuating fluid FL that is infused into the pressure-accumulating space 20I passes through a plurality of gas supply holes 22 that are provided in the side portion 20S of the piston 20, and flows into the clearance tc between the side portion 20S of the piston 20 and an inner wall 30I of the cylinder 30. A gas bearing GB forms as a result between the piston 20 and the inner wall 30I of the cylinder 30.

In the embodiment, the gas that fills the interior of the crankcase inner space CS of the chassis 100C is pressurized. If the gas bearing pump 120 is disposed outside the chassis 100C, therefore, the actuating fluid FL cannot be caused to flow out of the pressure-accumulating space 20I, via the gas supply holes 22, unless the gas bearing pump 120 feeds the actuating fluid FL into the pressure-accumulating space 20I at least at a pressure higher than the pressure in the crankcase inner space CS. Such being the case, if the gas bearing pump 120 were provided inside the chassis 100C, the gas bearing pump 120 would need only feed already-pressurized actuating fluid FL into the pressure-accumulating space 20I. This would allow reducing the workload of the gas bearing pump 120 as required for forming the gas bearing GB.

The Stirling engine 100 illustrated in FIG. 1 has a fluid passage that connects a first space filled with the actuating fluid of the Stirling engine 100, as a piston engine, and a second space on the side of the piston 20 opposite the first space. The fluid passage is provided with a passage opening/closing means capable of opening/closing the fluid passage. In the Stirling engine 100 according to the embodiment, the high temperature-side actuating fluid space MSH or the low temperature-side actuating fluid space MSL, i.e. the actuating fluid space MS, corresponds to the first space, while the crankcase inner space CS corresponds to the second space. In the embodiment, the low temperature-side actuating fluid space MSL is connected to the crankcase inner space CS by way of a fluid passage 40. The fluid passage 40 has a passage opening/closing valve 41 as a passage opening/closing means.

The passage opening/closing valve 41 may have, for instance, a solenoid valve. As illustrated in FIG. 1, the passage opening/closing valve 41 is electrically connected to an electronic control unit (ECU) 50 for controlling the Stirling engine 100, so that opening/closing of the passage opening/closing valve 41 is controlled by the ECU 50. When the passage opening/closing valve 41 opens, the actuating fluid space MS and the crankcase inner space CS are connected with each other by way of the fluid passage 40. When the passage opening/closing valve 41 closes, the actuating fluid space MS and the crankcase inner space CS are shut off from each other.

The actuating fluid space MS and the crankcase inner space CS are shut off from each other when the passage opening/closing valve 41 closes during operation of the Stirling engine 100. The high temperature-side piston 20H and the low temperature-side piston 20L execute a reciprocating motion by virtue of changes in the pressure of the actuating fluid in the actuating fluid space MS and the heat exchanger 108, on account of the thermal energy received by the heater 105. This reciprocating motion is converted into rotational motion, and is outputted as such, by the crankshaft 110.

Figure 4:
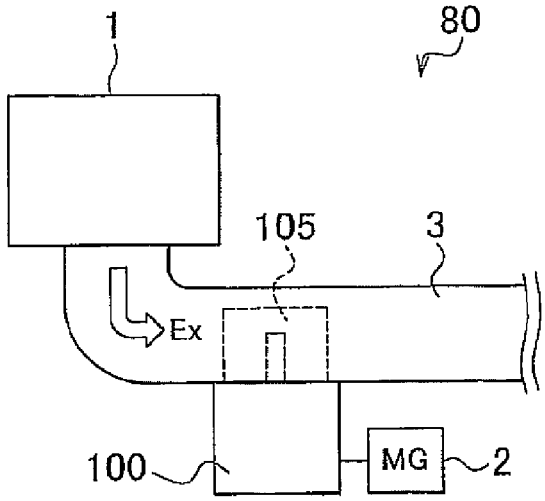
FIG. 4 is a conceptual diagram illustrating a configuration example of a waste heat recovery system that uses the Stirling engine according to the embodiment.

FIG. 4 is a conceptual diagram illustrating a configuration example of a waste heat recovery system that uses the Stirling engine according to the embodiment. The waste heat recovery system 80 includes, for instance, an internal combustion engine 1, as a driving force source, installed in a vehicle; the Stirling engine 100; and a generator 2 that is driven by the Stirling engine 100.

The heater 105 of the Stirling engine 100 is disposed inside the heater case 3. The heater case 3 functions also as a passage for the exhaust gas Ex that is discharged out of the internal combustion engine 1. The exhaust gas Ex discharged out of the internal combustion engine 1 heats the actuating fluid of the Stirling engine 100 by way of the heater 105. As a result, the Stirling engine 100 generates a driving force through recovery of the thermal energy of the exhaust gas Ex. The generator 2 generates electric power by being driven on account of the driving force generated by the Stirling engine 100. In the waste heat recovery system 80, thus, the internal combustion engine 1 is the object of waste heat recovery by the Stirling engine 100.

Figure 5:
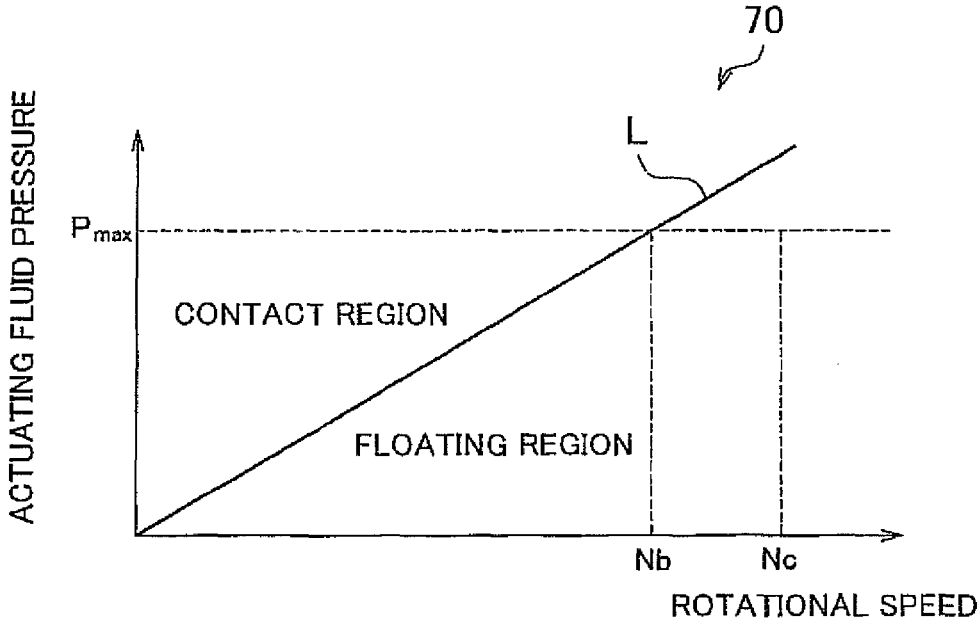
FIG. 5 is a conceptual diagram illustrating a map for discriminating between a floating region and a contact region of a piston in a structure wherein a piston is supported in a cylinder by way of a gas bearing.

FIG. 5 is a conceptual diagram illustrating a map for discriminating between a floating region and a contact region of a piston in a structure wherein a piston is supported in a cylinder by way of a gas bearing. In the map 70 of FIG. 5, the vertical axis represents the pressure of the actuating fluid in the actuating fluid space MS of the Stirling engine 100 illustrated in FIG. 1, and the horizontal axis represents the rotational speed of the crankshaft 110 of the Stirling engine 100.

The straight line L in the map 70 demarcates a region at which the piston 20 and the cylinder 30 of the Stirling engine 100 come into contact with each other (contact region), and a region at which the piston 20 floats in the cylinder 30 by way of the gas bearing or a region of allowable contact between the piston 20 and the cylinder 30 (floating region). For a given rotational speed, the region where the pressure of the actuating fluid is higher than the straight line L is the contact region, and the region where the pressure of the actuating fluid is lower than the straight line L is the floating region. For a given actuating fluid pressure, the region at which the rotational speed is lower than the straight line L is the contact region, and the region at which the rotational speed is higher than the straight line L is the floating region. The relationship of the map 70 is a novel finding obtained through experimentation for finding a region at which the piston 20 floats in the cylinder 30. In the embodiment, as described above, the floating region includes conceptually not only a region at which the piston 20 floats in the cylinder 30 by way of the gas bearing, but also a region at which there occurs allowable contact between the piston 20 and the cylinder 30. Preferably, the floating region is the region at which the piston 20 floats in the cylinder 30 by way of the gas bearing.

The maximum actuating fluid pressure Pmax is the maximum pressure of the actuating fluid in the actuating fluid space MS, i.e. the first space, of the Stirling engine 100. The maximum actuating fluid pressure Pmax is determined by the specifications of the Stirling engine 100, so that the pressure of the actuating fluid in the actuating fluid space MS cannot be greater than the maximum actuating fluid pressure Pmax. Therefore, the region in the map 70 at which the rotational speed is greater than the rotational speed Nb of the crankshaft 110, at the intersection point of the straight line L and the maximum actuating fluid pressure Pmax, is of necessity the floating region. The rotational speed Nb is called the boundary rotational speed.

That is, when the rotational speed of the crankshaft 110 is greater than the boundary rotational speed Nb, the piston 20 floats in the cylinder 30. In the embodiment, therefore, the region at which the piston 20 floats in the cylinder 30, and the region at which the piston 20 comes into contact with the cylinder 30 are determined on the basis of a relationship between the pressure of the actuating fluid in the actuating fluid space MS and the engine rotational speed of the Stirling engine 100 (rotational speed of the crankshaft 110).

In the embodiment output is obtained from the Stirling engine 100 when the Stirling engine 100 operates in the floating region. For instance, the rated rotational speed Nc, at which there is obtained a rated output, is a rotational speed greater than the boundary rotational speed Nb. In the embodiment, the running Stirling engine 100 is stopped at the floating region. As a result, the Stirling engine 100 can stop while a non-contact state is preserved between the piston 20 and the cylinder 30. Loss of durability is therefore averted in the piston 20 and the cylinder 30, and thus the reliability of the Stirling engine 100 is enhanced.

Figure 6:
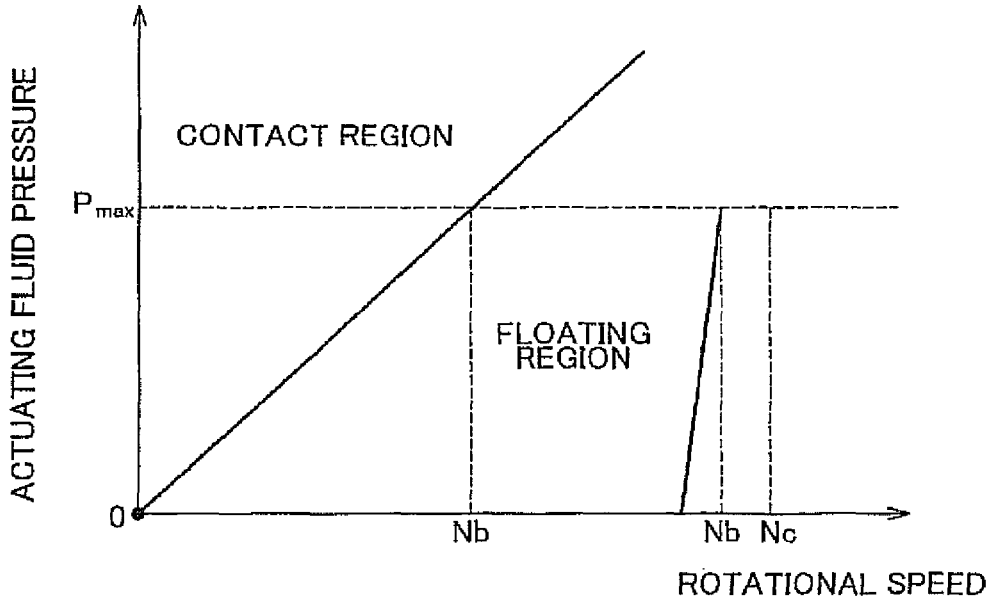
FIG. 6 is a diagram for explaining an example of stop timing in the Stirling engine of the embodiment.
Figure 7:
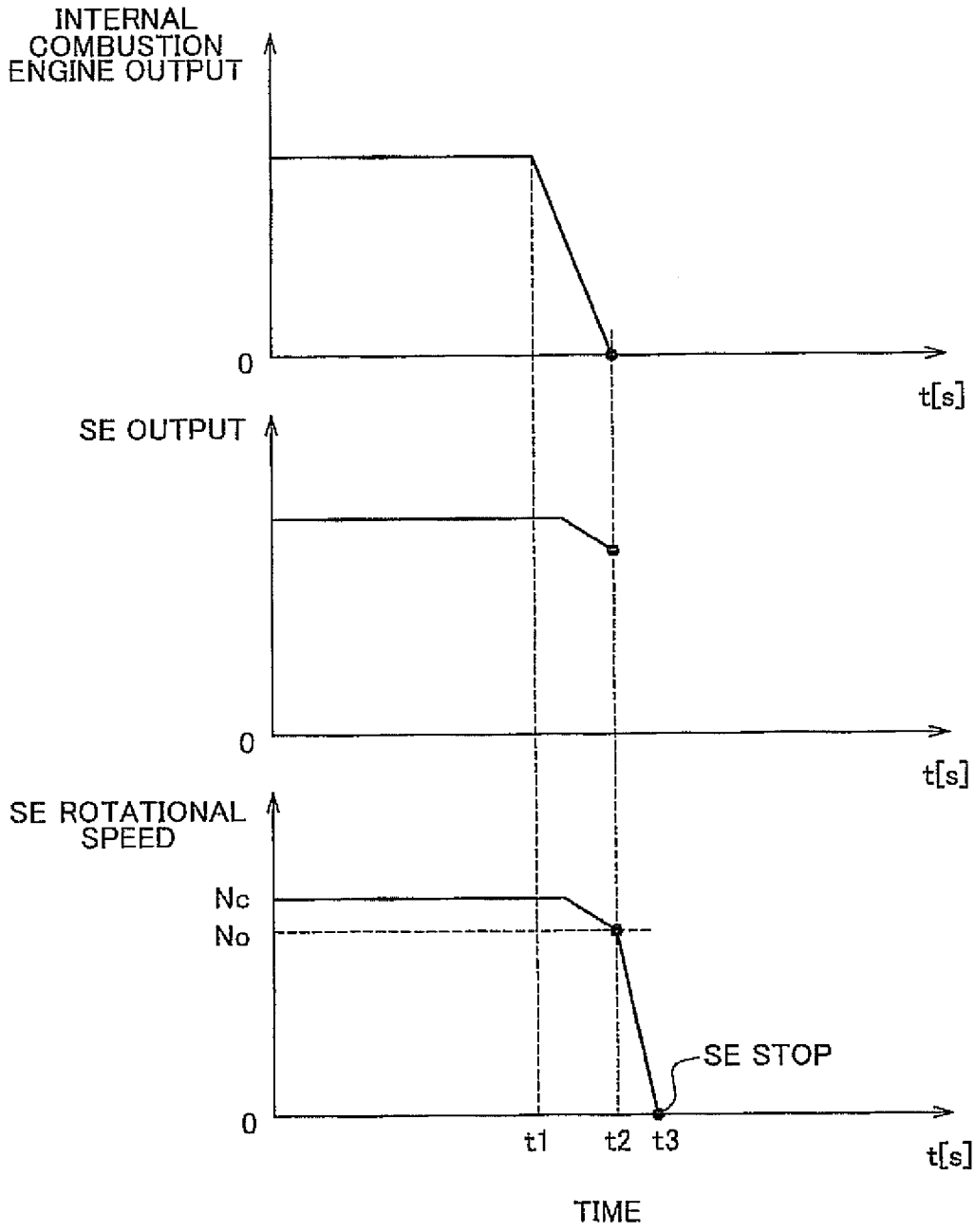
FIG. 7 is a diagram for explaining an example of stop timing in the Stirling engine of the embodiment.

FIGS. 6 and 7 are diagrams illustrating an example of stop timing in a Stirling engine. As illustrated in FIG. 6, when the Stirling engine 100 is running at the rated rotational speed, the output of the internal combustion engine 1 (internal combustion engine output), which is the object of waste heat recovery, begins dropping (time t=t1 in FIG. 7), after which the internal combustion engine 1 stops running (time t=t2 in FIG. 7). A drop in the output of the internal combustion engine is accompanied by a drop in the temperature of the exhaust gas Ex of the internal combustion engine 1. The thermal energy that the Stirling engine 100 can recover from the exhaust gas Ex decreases accordingly. A decrease in the thermal energy that is recoverable from the exhaust gas Ex translates into a drop of the rotational speed (SE rotational speed) of the crankshaft 110 of the Stirling engine 100. The driving force (SE output) of the Stirling engine 100 drops thus at the same time.

Stop of the internal combustion engine 1 causes the Stirling engine 100 to stop. Herein, the ECU 50 illustrated in FIG. 1 acquires the rotational speed of the crankshaft 110 by way of a crank angle sensor 140 illustrated in FIG. 1. Once the rotational speed of the crankshaft 110 equals a predetermined stop rotational speed No, the ECU 50 opens the passage opening/closing valve 41 (time t=t2). Thereupon, the actuating fluid space MS and the crankcase inner space CS come into communication with each other by way of the fluid passage 40, and the actuating fluid in the actuating fluid space MS moves into the crankcase inner space CS. Pressure becomes substantially the same thereby in the actuating fluid space MS and the crankcase inner space CS. As a result, the pressure amplitude of the actuating fluid in the actuating fluid space MS becomes substantially 0, i.e. the Stirling engine 100 enters a load-less state, and stops (time t=t3). Herein, the stop rotational speed No is set to a value smaller than the rated rotational speed Nc but greater than the boundary rotational speed Nb.

In the embodiment, thus, the passage opening/closing valve 41 is opened, and the Stirling engine 100 is stopped, in a state where the rotational speed of the crankshaft 110 of the Stirling engine 100 is greater than the boundary rotational speed Nb. Therefore, the Stirling engine 100 can stop in a state where the piston 20 is floating off the cylinder 30. This allows suppressing, as a result, a decrease in durability of the piston 20 and/or the cylinder 30, and thus the reliability of the Stirling engine 100 is enhanced. In the above explanation, the rotational speed of the crankshaft 110 of the Stirling engine 100 equals the stop rotational speed No at the timing at which the internal combustion engine 1 stops. The passage opening/closing valve 41 remains closed when the rotational speed of the crankshaft 110 is greater than the stop rotational speed No at the timing at which the internal combustion engine 1 stops. The passage opening/closing valve 41 is opened once the rotational speed of the crankshaft 110 equals the stop rotational speed No. Conversely, the passage opening/closing valve 41 is opened at the point in time at which the rotational speed of the crankshaft 110 reaches the stop rotational speed No before stopping of the internal combustion engine 1.

Figure 8:
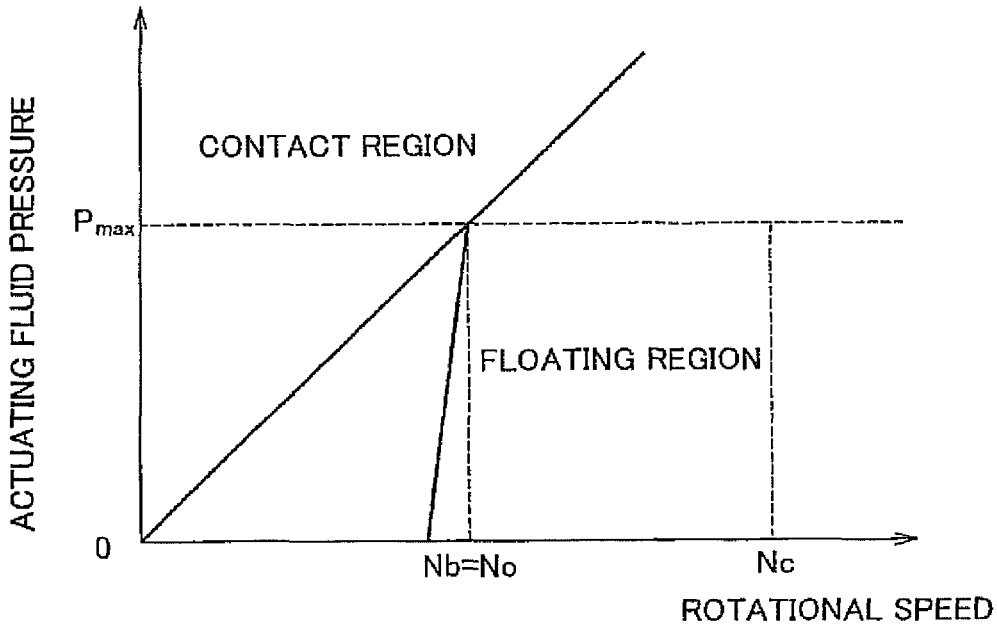
FIG. 8 is a diagram for explaining another example of stop timing in the Stirling engine of the embodiment.
Figure 9:
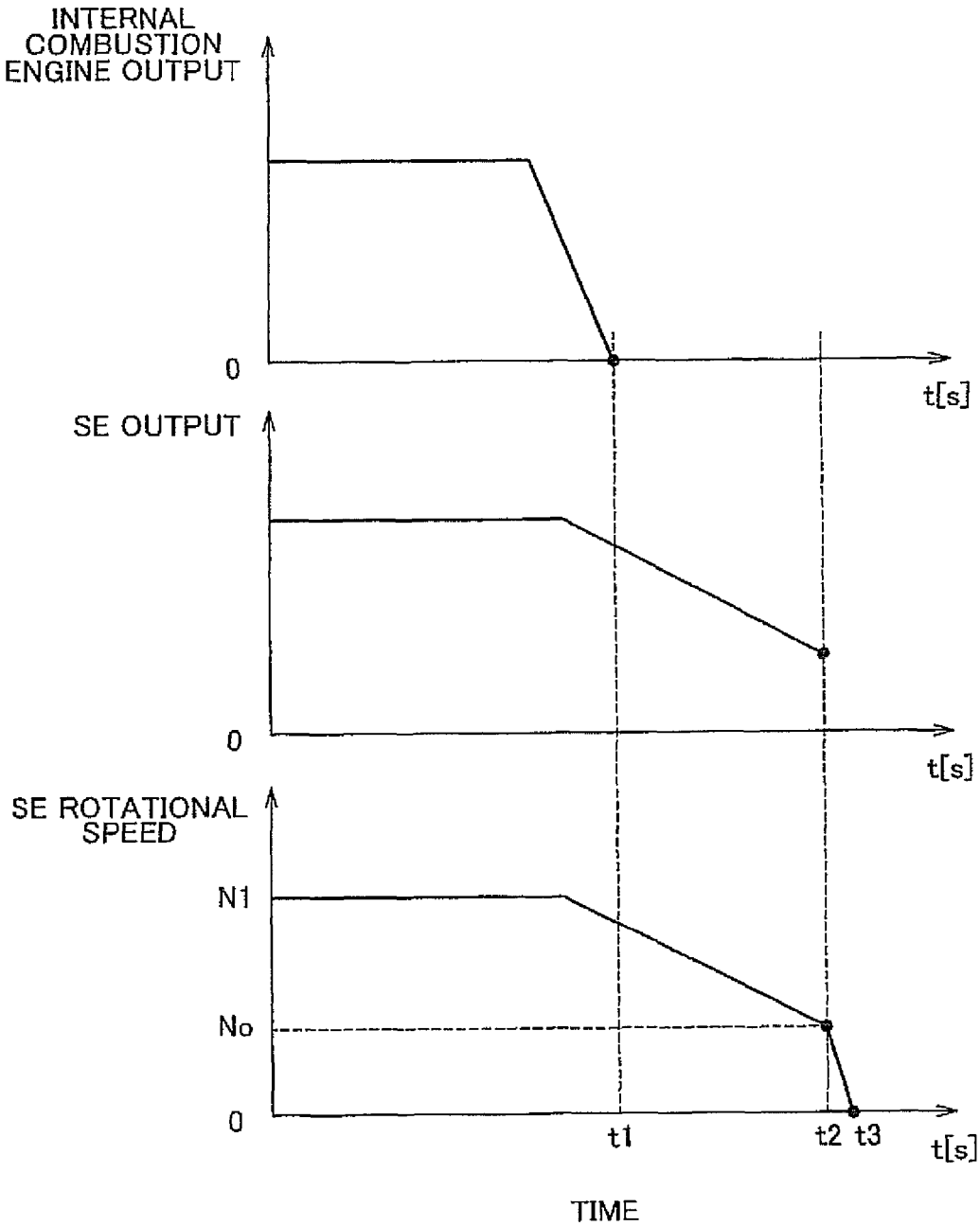
FIG. 9 is a diagram for explaining another example of stop timing in the Stirling engine of the embodiment.

FIGS. 8 and 9 are diagrams illustrating another example of stop timing in the Stirling engine of the embodiment. In this example, the Stirling engine 100 stops when the Stirling engine 100 performs residual-heat operation. Residual-heat running refers to running of the Stirling engine 100 by exploiting residual heat stored in the heater 105 of the Stirling engine 100.

The internal combustion engine 1, which is the object of waste heat recovery, stops running (time t=t1 in FIG. 9) with the Stirling engine 100 running at the rated rotational speed, as illustrated in FIG. 8. Thereupon, exhaust gas Ex stops being supplied from the internal combustion engine 1 to the heater 105 of the Stirling engine 100. The Stirling engine 100 goes on running on account of residual heat in the heater 105, but the rotational speed (SE rotational speed) of the crankshaft 110 of the Stirling engine 100 decreases as the residual heat remaining in the heater 105 dwindles. The driving force (SE output) of the Stirling engine 100 drops at the same time.

Stop of the internal combustion engine 1 causes the Stirling engine 100 to stop. Herein, the ECU 50 illustrated in FIG. 1 acquires the rotational speed of the crankshaft 110 by way of the crank angle sensor 140 illustrated in FIG. 1. Once the rotational speed of the crankshaft 110 equals a predetermined stop rotational speed No, the ECU 50 opens the passage opening/closing valve 41 (time t=t2). In residual-heat running, the passage opening/closing valve 41 delays the timing for opening the fluid passage 40 up to the boundary between the region at which the piston 20 floats in the cylinder 30 (floating region) and the region at which the piston 20 does not float in the cylinder 30 (contact region). The rotational speed of the crankshaft 110 at the boundary between the floating region and the contact region is the boundary rotational speed Nb. During residual-heat running, therefore, the stop rotational speed No is the boundary rotational speed Nb. Residual-heat running can be realized thus to the maximum extent possible while avoiding contact between the piston 20 and the cylinder 30.

In the embodiment, the timing for opening the fluid passage 40 is delayed up to the boundary between the contact region and the floating region, i.e. up to immediately before the contact region. For safety reasons, the fluid passage 40 may also be opened before the rotational speed of the crankshaft 110 reaches the boundary between the contact region and the floating region (i.e. reaches the boundary rotational speed Nb). To prolong then the time of residual-heat running as much as possible, the stop rotational speed No is set to a value that results from adding a predetermined margin rotational speed Nm to the boundary rotational speed Nb, such that the margin rotational speed Nm takes on the smallest value possible. The margin rotational speed Nm takes into account, among others factors, variations between engines, tolerances and so forth, and is determined through experimentation and analysis. Residual-heat running can be realized thus over a prolonged lapse of time while contact between the piston 20 and the cylinder 30 is avoided yet more reliably.

The actuating fluid space MS and the crankcase inner space CS are brought into communication with each other by the fluid passage 40 when the passage opening/closing valve 41 is opened, whereupon the actuating fluid in the actuating fluid space MS moves into the crankcase inner space CS. As a result, the pressure becomes substantially the same in the actuating fluid space MS and the crankcase inner space CS. As a result, the pressure amplitude of the actuating fluid in the actuating fluid space MS becomes substantially 0, i.e. the Stirling engine 100 enters a load-less state, and stops (time t=t3). In residual-heat running, thus, the timing at which the passage opening/closing valve 41 opens is delayed until the rotational speed of the crankshaft 110 of the Stirling engine 100 reaches the boundary rotational speed Nb, whereupon the Stirling engine 100 is stopped. As a result, the greatest possible residual-heat running can be realized while in a state where contact between the piston 20 and the cylinder 30 is avoided. This allows suppressing a decrease in durability of the piston 20 and/or the cylinder 30, and thus the reliability of the Stirling engine 100 is enhanced.

The piston engine according to the embodiment of the invention is useful as a piston engine in which a gas bearing is interposed between a piston and a cylinder, and is particularly suitable for stopping such a piston engine.

What is claimed is:

1. A piston engine, comprising:

a cylinder;

a piston that moves reciprocally in the cylinder wherein the piston engine converts reciprocating motion of the piston into rotational motion and outputs the rotational motion;

a gas bearing that is interposed between the cylinder and the piston;

a fluid passage that connects a first space with a second space on an opposite side of the piston to the first space, the first space is an accumulated fluid space formed in the cylinder and the accumulated fluid space is filled with an actuating fluid, the second space is a space in which a motion conversion member that converts reciprocating motion of the piston into rotational motion is disposed;

a passage opening/closing valve provided in the fluid passage; and a passage opening/closing portion that opens and closes the fluid passage by controlling the passage opening/closing valve;

wherein, upon stopping of the piston engine, the passage opening/closing portion enables communication through the fluid passage when the piston engine is running in a region at which the piston floats in the cylinder, the region being determined based on the pressure of the actuating fluid in the first space and the engine rotational speed of the piston engine.

2. The piston engine according to claim 1, wherein the piston engine operates through heating of the actuating fluid by a heater, such that when the piston engine operates on account of residual heat in the heater, the passage opening/closing portion delays timing for opening the fluid passage up to a boundary between a region at which the piston floats in the cylinder and a region at which the piston does not float in the cylinder.

3. The piston engine according to claim 2, wherein the piston engine is a Stirling engine, and wherein the Stirling engine includes a first cylinder; a first piston that moves reciprocally in the first cylinder; a second cylinder; a second piston that moves reciprocally in the second cylinder; and the heater disposed between the first cylinder and the second cylinder.

4. The piston engine according to claim 1, wherein the passage opening/closing portion enables communication through the fluid passage when the rotational speed of the piston engine is not greater than a rated rotational speed at which rated output is obtained.

5. A piston engine, comprising:

a cylinder;

a piston that moves reciprocally in the cylinder wherein the piston engine converts reciprocating motion of the piston into rotational motion and outputs the rotational motion;

a gas bearing interposed between the cylinder and the piston;

a fluid passage that connects a first space with a second space on an opposite side of the piston to the first space, the first space is an accumulated fluid space formed in the cylinder and the accumulated fluid space is filled with an actuating fluid, the second space is a space in which a motion conversion member that converts reciprocating motion of the piston into rotational motion is disposed;

a passage opening/closing valve provided in the fluid passage; and a passage opening/closing portion that opens and closes the fluid passage by controlling the passage opening/closing valve;

wherein, upon stopping of the piston engine, the passage opening/closing portion enables communication through the fluid passage when the piston engine is running in a state in which the cylinder and the piston are not in contact with each other.

6. The piston engine according to claim 5, wherein the piston engine operates through heating of the actuating fluid by a heater, such that when the piston engine operates on account of residual heat in the heater, the passage opening/closing portion delays timing for opening the fluid passage up to a boundary between a region at which the piston is in contact with the cylinder and a region at which the piston is not in contact with the cylinder.

7. The piston engine according to claim 6, wherein the piston engine is a Stirling engine, and wherein the Stirling engine includes a first cylinder; a first piston that moves reciprocally in the first cylinder; a second cylinder; a second piston that moves reciprocally in the second cylinder; and the heater disposed between the first cylinder and the second cylinder.

8. The piston engine according to claim 5, wherein the passage opening/closing portion enables communication through the fluid passage when the rotational speed of the piston engine is not greater than a rated rotational speed at which rated output is obtained.

* * * * *